US005924253A

United States Patent [19]

Walker

[11] Patent Number: 5,924,253

[45] Date of Patent: Jul. 20, 1999

[54] COVER ATTACHMENT APPARATUS

[76] Inventor: Patrick J. Walker, 845 Brisbin St., Anoka, Minn. 55303

[21] Appl. No.: 08/771,870

[22] Filed: Dec. 23, 1996

[51] Int. Cl.[6] ..... A47B 13/08; A47B 95/04

[52] U.S. Cl. ..... 52/415; 52/782.24; 52/796.12; 52/718.01; 52/288.1; 312/140.3; 108/27

[58] Field of Search ..... 52/415, 418, 389, 52/391, 782.2, 782.21, 782.22, 782.23, 782.24, 796.12, 797.1, 802.1, 802.11, 718.01, 284, 285.1, 285.3, 286, 254, 259, 287.1, 288.1, 718.05, 716.1, 718.02; 312/140.3, 140.4; 108/27

[56] References Cited

U.S. PATENT DOCUMENTS

| | | | |
|---|---|---|---|
| 1,917,139 | 7/1933 | McCutcheon | 52/254 |
| 2,194,421 | 3/1940 | Saussure, Jr. | 52/782.23 |
| 2,476,215 | 7/1949 | Patton | D23/308 X |
| 2,541,768 | 2/1951 | Keller | 52/287.1 |
| 2,892,337 | 6/1959 | Filsinger | 52/284 |
| 3,309,832 | 3/1967 | Filsinger | 52/287.1 X |
| 3,953,268 | 4/1976 | Dillon | 52/287.1 X |
| 4,996,817 | 3/1991 | Nelson | 52/782.2 |
| 5,073,430 | 12/1991 | Aidan | 52/254 X |
| 5,253,932 | 10/1993 | Nesovic | 312/140.3 |
| 5,310,435 | 5/1994 | Kelly | 52/796.12 X |
| 5,348,384 | 9/1994 | Hull et al. | 312/140.3 |
| 5,470,140 | 11/1995 | Schagunn | 312/140.3 |

FOREIGN PATENT DOCUMENTS

| | | | |
|---|---|---|---|
| 568649 | 7/1958 | Belgium | 52/389 |
| 607983 | 11/1960 | Canada | 52/782.24 |
| 1123870 | 2/1962 | Germany | 52/782.2 |
| 2749481 | 5/1979 | Germany | 108/27 |
| 3329172 | 2/1985 | Germany | 108/27 |
| 7504329 | 10/1976 | Netherlands | 52/389 |
| 4161164 | 9/1934 | United Kingdom | 52/718.01 |

OTHER PUBLICATIONS

Countertops (Cement Mortar C511–95; Thin–Bed C512–95; Cementious Backer Units C513–95).

*Primary Examiner*—Carl D. Friedman
*Assistant Examiner*—Laura A. Callo
*Attorney, Agent, or Firm*—Nawrocki, Rooney & Sivertson, P.A.

[57] ABSTRACT

Attachment apparatus and methods of attachment of a cover to the edge of a horizontal surface will provide a protective and/or a decorative edge. The cover has an outwardly extending step with a groove extending into the surface opposite the cover. This groove has an opening into a wider extension into the step interior. The step is hooked over the top of the horizontal surface, the cover is pressed against the edge of the horizontal surface, and the space above the horizontal surface up to the top of the cover and the groove are filled with mortar, which locks the cover in place and provides a new upper surface. Clips, extending into the groove, can also be used to further secure the cover. If desired, an upper tile and/or a cement backing sheet can also be placed respectively on and/or within the mortar.

5 Claims, 3 Drawing Sheets

COVER ATTACHMENT APPARATUS

FIELD OF THE INVENTION

This invention relates to the field of a cover attachment for a surface to provide an edge for such a surface, and particularly in using the cover itself to orient and space its relationship with respect to such a surface with no separate jigs or fixtures being used.

BACKGROUND OF THE INVENTION

Attaching a cover to provide an edge for a horizontal surface such as a countertop is a commonly used technique, and this is true in various types of construction both within and without a building. Typically the cover will provide a dam for mortar which fills the volume from the horizontal surface to the top edge of the cover. This requires, in a countertop application, that the top edge of the cover be oriented horizontally. In order to provide mortar of an acceptable thickness above the horizontal surface the extension of the cover above the surface must be a particular predetermined distance. If a tile, or other surface, is to be secured above the underlying horizontal surface, the extension of the cover above the horizontal surface must be made adequate to accommodate the additional tile thickness.

The attachment means currently in use is simply to nail a cover to the edge of the horizontal surface. While this does provide an attachment means, it is not necessarily secure over time. Force exerted on the top edge of the cover, which occurs particularly when the cover is used for a horizontal stair tread, can loosen the attachment nails over a period of time. Using this method of attachment, the nail heads also show, which is undesirable for many uses. If so, the nail heads must be covered using other material which requires additional steps. Further, as discussed above, the cover must be nailed to the horizontal surface with the top edge parallel to the horizontal surface and at a predetermined distance from the surface. Since accuracy and repeatability are probably required in this step, this may well call for the use of some type of jig or fixture to accurately align and offset the cover with respect to the horizontal surface.

It would be desirable to be able to readily, easily, and securely attach a cover to the edge of a horizontal surface, with the attachment means concealed, with the top edge of the cover parallel to the horizontal surface, and with the top edge of the cover extending a predetermined amount above the horizontal surface, without the use of any jigs or fixtures.

SUMMARY

Using this apparatus and/or method of attachment, a cover can be readily, easily and securely attached across the outer edge of a horizontal countertop, shelf, ledge, partition, step, or any other horizontal surface with the top edge of the cover parallel to and projecting upward a predetermined amount from a horizontal surface without using either a jig or a fixture. The cover, since the method of attachment is concealed, provides an outer edge for a horizontal surface which is both protective and decorative.

The attachment means for the cover, which is planar and rectangular in shape, uses an integral outwardly extending step. The step extends outward across the cover length perpendicularly and adjacent to an edge. The outer surface of the step, on the side opposite the cover, is generally parallel to the cover. This outer surface contains a groove having an opening into an inward extending extension with the extension being wider than the opening.

To attach the cover, the cover is first oriented parallel to the exposed outer edge of the horizontal surface to be covered with the step uppermost and facing the horizontal surface. The cover is then simply "hooked" over the horizontal surface using the step, and the cover pressed and held against the outer edge of the horizontal surface. This automatically aligns the upper edge of the cover parallel with the horizontal surface. The step dimensions are is made such that the distance from the top of the cover to the horizontal surface is the desired predetermined distance. No jigs or fixtures are required to orient and position the cover relative to the horizontal surface as required, since the step itself provides all of these functions.

In a first embodiment, after the step has been hooked to the horizontal surface, the cover is simply held in place while mortar is trowelled over the horizontal surface up to the top edge of the cover, and into the groove in the outer surface of the step. The upper surface of the mortar is trowelled horizontal to the original horizontal surface in the plane of the upper edge of the cover.

The cover is released after the mortar has set to complete the installation. The upper surface of the mortar now provides a new upper horizontal surface, and the mortar holds the cover securely in place by extending into the groove through the narrow opening into the wider extension. This holds the cover against the horizontal surface interlocked in a manner similar to that of a dovetail joint.

A variation of this first embodiment, when a tile or an equivalent separate surface is to provide the upper horizontal surface, is to place the tile on the mortar, after the mortar has been spread across the original horizonal surface up to a level which will support the tile with its upper surface in the plane of the upper edge of the cover. After the tile is in place, the gap between the edge of the tile and the cover is then filled. Again, after the mortar has set the installation is complete.

A second embodiment of the invention is used only when tile, or an equivalent separate surface, is to be the upper horizontal surface. Once again, the step is hooked over the horizontal surface, and the cover pressed against the outer edge of the horizontal surface. At this time a number of clips, having an offset projection, are attached to the horizontal surface with their projections extending into the groove in the outer surface of the step. This attaches the step to the horizontal surface. After the clips have been installed, the cover is no longer supported against the edge of the horizontal surface since the clips now hold it in place.

A first sheet of mortar is spread across the horizontal surface also partially filling the groove in the step. A generally planar cement backing sheet is placed upon the first sheet of mortar, and a second sheet of mortar is spread around and across the upper surface of the cement backing sheet up to a level which will support the tile with its upper surface in the plane of the upper edge of the cover, and also completely filling the groove. A ceramic tile is placed upon the second sheet of mortar and the space around the tile filled with mortar. After the mortar has set the installation is complete.

In a variation of this second embodiment, the cement backing sheet is omitted and only a single sheet of mortar used. Here, after the clips are installed, the mortar is spread across the original horizonal surface up to a level which will support the tile with the upper surface of the tile in the plane of the upper edge of the cover and also filling the groove. After the tile is in place, the gap around the edge of the tile is again filled. After the mortar has set the installation is complete.

In the second embodiment, both the mortar and the clips extending into the groove securely lock the cover in place. The predetermined distance of the upper edge of the cover from the original horizontal surface is made precisely the amount necessary to accommodate the mortar, the backing sheet and the tile, and in the variation the predetermined distance accommodates only the mortar and the tile.

This apparatus and/or method of attachment provides a simple and secure attachment of a cover to a horizontal surface with all of the attachment means concealed, and with no jigs or fixtures being used in the installation.

Various advantages and features of novelty which characterize this invention are pointed out with particularity in the claims annexed hereto and forming a part hereof. However, for a better understanding of the invention, its advantages, and objects attained by its use, reference should be made to the drawing which forms a further part hereof, and to the accompanying descriptive matter, which illustrates and describes the preferred embodiment of the invention.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE INVENTION

Figure 1:
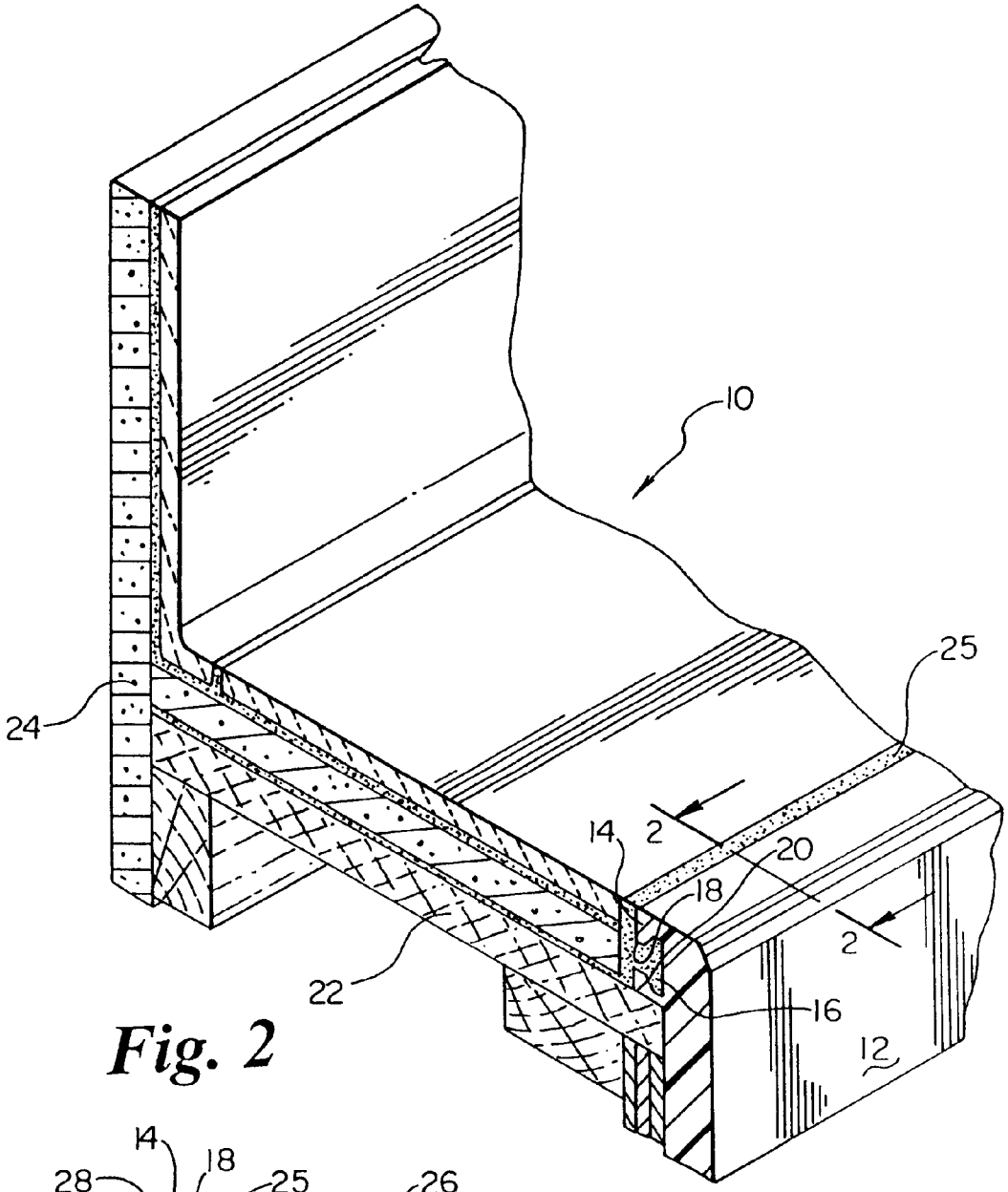
FIG. 1 is a cut-away perspective view of a first embodiment of the invention within its environment.
Figure 2:
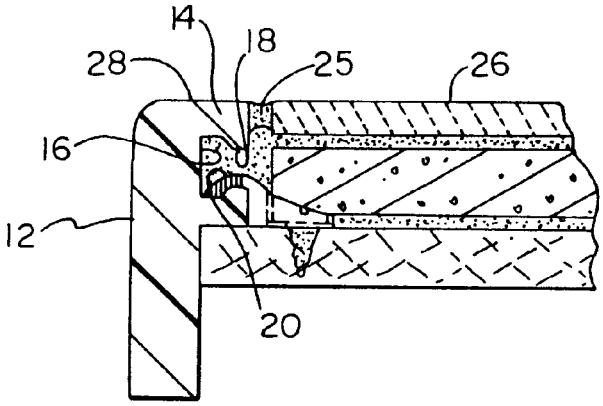
FIG. 2 is a cross-sectional view taken along line 2—2 of FIG. 1.

Referring to FIGS. 1 and 2, a first embodiment of the apparatus 10 according to the invention is shown to comprise cover 12 and projecting integral step 14. Step 14 has a groove 16 formed in a first generally planar surface and extending into the surface. Groove 16 has an opening 18 into a wider inward extension 20. Unfinished surface 22 is shown supported in a horizontal plane by building structure 24.

Mortar 25 extends upward from surface 22 and forms a new horizontal surface 26 in the plane of the upper edge 28 of step 14. Mortar 25 also extends into groove 16 completely filling its opening 18 and extension 20. Mortar 25 both forms the new upper horizontal surface 26, in part, and also locks cover 12, which forms a new edge for horizontal surface 22, to the horizontal surface.

The vertical dimension of step 14 provides the depth of mortar 26, while the mortar extending into groove 16, since its opening 18 is narrower than its extension 20, locks the step to the horizontal surface. This locking function is similar to that of a dovetail joint in that, as in a dovetail joint, either mortar 26 or the side wall of opening 18 must be sheered away to remove step 14, holding cover 12, from horizontal surface 22.

To attach cover 12 to horizontal surface 22, the cover is first oriented as shown in FIG. 1. Step 14 of cover 12 is then "hooked" over the edge of the horizontal surface 14, and the cover pressed against the outer edge of the horizontal surface. This orients cover 12 parallel to the outer edge of horizontal surface 22 with its upper surface 28 horizontal to the horizontal surface and spaced above it a distance equal to the width of step 14, which simply uses the orientation and width of the step for this process.

Horizontal surface 22 is then covered with mortar 26 up to the horizontal plane level with upper edge 28 of step 14, and simultaneously the opening 18 and extension 20 of groove 16 is filled with mortar. The upper surface of mortar 26 provides the new upper horizontal surface which is trowelled smooth. After mortar 26 has set, cover 12 need no longer be pressed against horizontal surface 22, since the installation is now complete with the mortar itself holding the cover securely in place.

Figure 3:
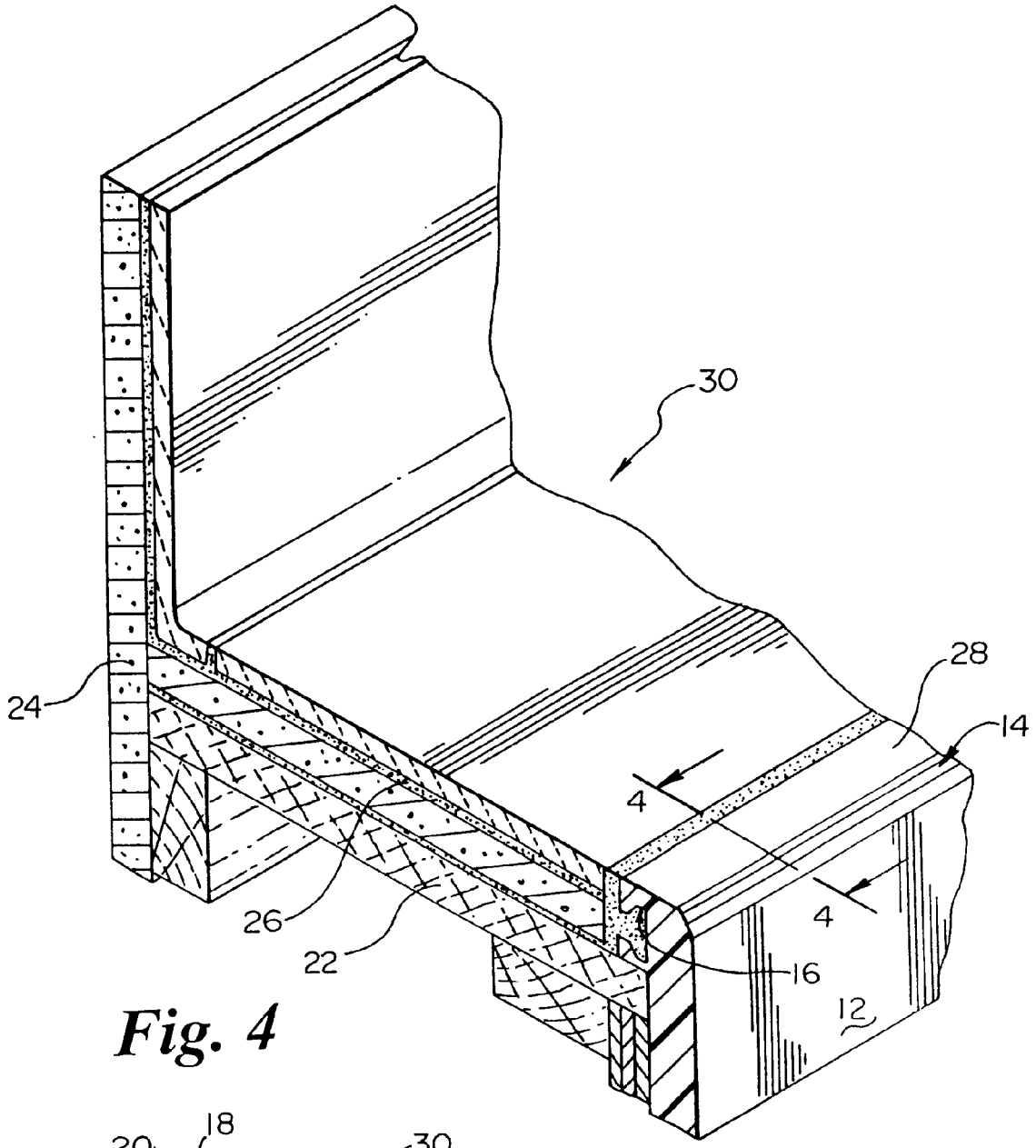
FIG. 3 is a cut-away perspective view of a variation of the first embodiment of the invention within its environment.
Figure 4:
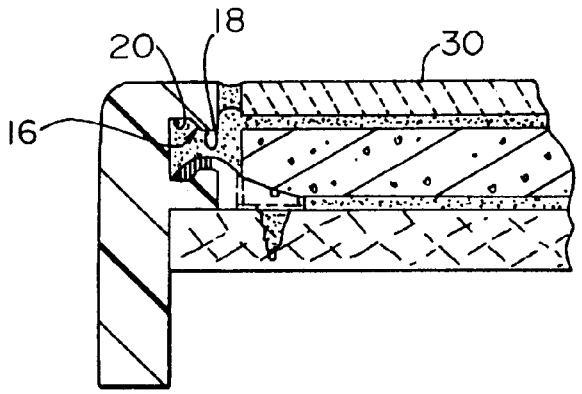
FIG. 4 is a cross-sectional view taken along line 4—4 of FIG. 3.

Referring to FIGS. 3 and 4, a variation of the first embodiment of the apparatus 10 according to the invention has a tile 30 added as the upper surface. Other than that the arrangement of the apparatus is identical to that of the first embodiment shown in FIGS. 1 and 2.

Step 14 of cover 12 is "hooked" over the edge of the horizontal surface 14, and cover 12 pressed against the outer edge of the horizontal surface, as before.

Horizontal surface 22 is then covered with mortar 26 up to a horizontal plane which will support tile 30 with its upper surface level with upper surface 28 of step 14, and opening 18 and extension 20 of groove 16 are simultaneously filled with mortar. Tile 30 is then placed upon the mortar and the spaces around the edge of the tile is filled with mortar. The upper surface of tile 30 now provides the new upper horizontal surface. After mortar 26 has set, cover 12 again need no longer be pressed against horizontal surface 22, since the mortar is holding the cover securely in place, as before.

Figure 5:
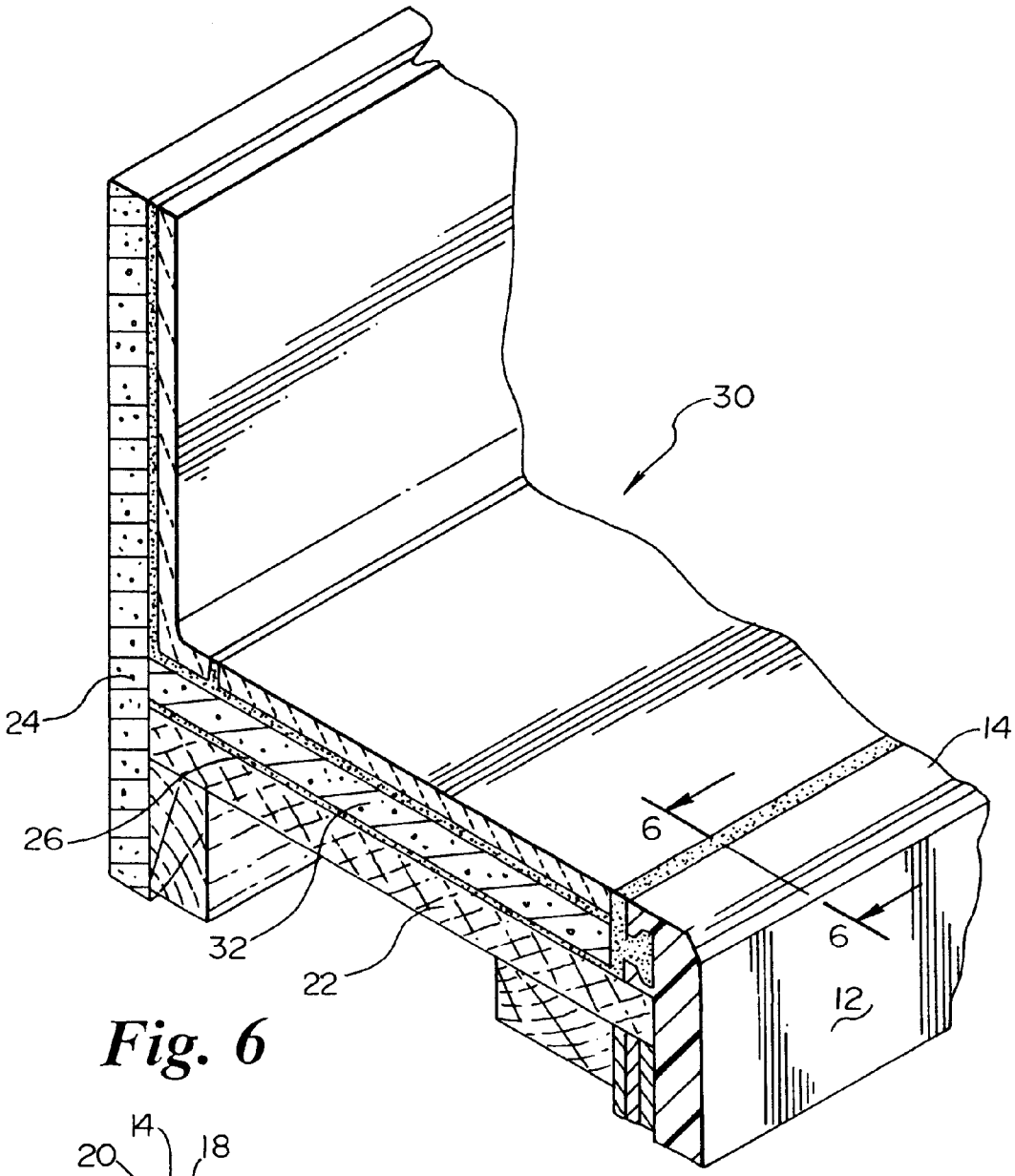
FIG. 5 is a cut-away perspective view of a second embodiment of the invention within its environment.
Figure 6:
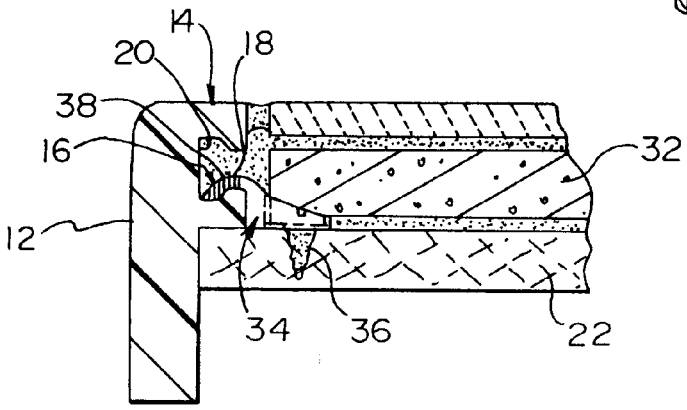
FIG. 6 is a cross-sectional view taken along line 6—6 in FIG. 5.
Figure 7:
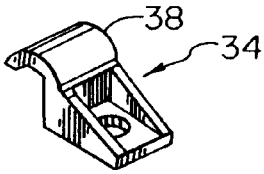
FIG. 7 is a perspective view of a clip detail.

A second embodiment in FIGS. 5, 6 and 7 is shown to again comprise cover 10 and projecting integral step 14. Step 14 has a groove 16 with an opening 18 into a wider inward extension 20 as before. Horizontal surface 22 is again supported in a horizontal plane by building structure 24.

A tile 30 forms a new upper horizontal surface and a generally planar cement backing sheet 32 is located above horizontal surface 22. A plurality of clips 34, secured across horizontal surface 22 by screws 36 into horizontal surface 22 and along the length of step 14, have an outward projection 38 which extends into opening 18 along inward extension 20 of groove 16. Both projection 38 and extension 20 curve outward and match each other to provide a positive grip of clip 34 on step 14.

Mortar 26 fills the spaces around tile 30, between the tile and cement backing sheet 32, between the backing sheet and horizontal surface 22 and into groove 16 completely filling it.

To attach cover 12 to horizontal surface 22, step 14 is hooked over the edge of the horizontal surface 14, and cover 12 is pressed against the outer edge of the horizontal surface, as described before. At this time however for this embodiment, projections 38 of clips 34 are then inserted into grooves 16 and attached to horizontal surface 22 by screws 36, as shown in FIG. 6.

Cover 12 is then released being held in place now by clips 34. A thin layer of mortar 26 is then spread across horizontal surface 22 and cement backing sheet 32 placed over it. A second layer of mortar 26 is placed over and around the backing sheet 34 and into groove 16 such as to completely fill the spaces around the backing sheet and within the groove.

Tile 30 is the placed upon the second layer of mortar 26 and additional mortar placed around the tile such as to form a complete surface in the upper plane of the tile. After mortar 26 has set both the mortar and clips 34 then secure cover 12 to horizontal surface 22.

While step 14 has been illustrated as being an integral part of cover 12, the step can be a separate part which is attached to the cover and will produce the same result. Further, while mortar is contemplated as the preferred material to extend into the groove to lock the parts together and, in some cases, to provide the upper surface, any material having an initial plastic state such that the material can be placed in the locations illustrated, which will set into a solid state over time, and which provides acceptable strength, can also be used. It is anticipated that a number of materials have such characteristics and can be used instead of mortar with similar results.

Omitting the upper tile and/or the cement backing sheet from either embodiment is an obvious variation within the scope of this invention. The addition or subtraction of these elements have no effect on the effectiveness of the attachment means itself.

Some embodiments and variations of the embodiments of this apparatus provide an attachment means which attaches a cover to a horizontal surface readily, easily, and securely, with the attachment means being concealed, with the upper surface of the cover parallel to the horizontal surface extending a predetermined distance above the horizontal surface, while using no jig or fixture, but still providing accurate orientation and location of the cover.

A method of attachment using the above apparatus also provides these same advantages.

While this invention has been described with respect to specific embodiments, these descriptions are not intended to be construed in a limiting sense. Various modifications of the illustrative embodiments, as well as other embodiments of the invention, will be apparent to persons skilled in the art upon reference to these descriptions. It is therefore contemplated that the appended claims will cover any such modifications or embodiments as fall within the true scope of the invention.

I claim:

1. In combination, a cover to be attached to an unfinished surface, said cover having defined therein a generally planar surface having a groove formed therein and an expanded opening extending inward into said cover therefrom, and said cover having defined therein a seat disposed on said unfinished surface to position said cover in a desired orientation relative to said unfinished surface, wherein said seat is substantially perpendicular to said generally planar surface; and a material initially having a flowable plastic state, receivable proximate the unfinished surface and which flows into said groove and said expanded opening, which material solidifies into a solid state over time and maintains said cover in said desired orientation.

2. The combination as in claim 1 wherein said cover has a second generally planar surface, substantially parallel to said generally planar surface and spaced therefrom, and wherein said seat is substantially perpendicular to said generally planar surface and said spaced, generally parallel second generally planar surface interconnecting said generally planar surface and said spaced, generally parallel second generally planar surface; said groove being narrower than said expanded opening.

3. The combination as in claim 2 and further comprising a plurality of clips and means for attaching said clips to the unfinished surface; said clips having projection means for holding said seat against said unfinished surface by tightly clamping a lower portion of said cover defining said groove against said unfinished surface.

4. The combination as in claim 3 wherein said expanded opening has an interior surface adjacent the projection means of a clip when said projection means is positioned within said expanded opening holding said cover in place.

5. The combination as in claim 2 wherein said material initially having a flowable plastic state which solidifies into a solid state over time is mortar.

* * * * *